United States Patent [19]

Huebscher

[11] 4,044,348

[45] Aug. 23, 1977

[54] CIRCUIT ENERGIZATION INDICATOR WITH THERMAL TIMING MEANS TO MAINTAIN THE INDICATION FOR A PREDETERMINED TIME AFTER DE-ENERGIZATION

[75] Inventor: Richard G. Huebscher, Cleveland, Ohio

[73] Assignee: Gould Inc., Chicago, Ill.

[21] Appl. No.: 615,566

[22] Filed: Sept. 22, 1975

[51] Int. Cl.[2] ..... H01H 37/08; H01H 61/02

[52] U.S. Cl. ..... 340/227.1; 99/342; 219/453; 307/117; 337/107; 337/376

[58] Field of Search ..... 340/227 R, 227.1; 99/342, 344; 219/453; 307/117; 337/376, 102, 107, 85, 94, 362, 360

[56] References Cited

U.S. PATENT DOCUMENTS

| | | | |
|---|---|---|---|
| 3,612,826 | 10/1971 | Deaton | 219/453 |
| 3,617,971 | 11/1971 | Ellenberger | 337/107 |
| 3,840,834 | 10/1974 | Obenhaus et al. | 337/107 |
| 3,852,695 | 12/1974 | Northrup, Jr. | 337/102 |
| 3,852,728 | 12/1974 | Flagg, Jr. | 340/227 R |
| 3,909,812 | 9/1975 | Satorius | 340/227 R |

*Primary Examiner*—Glen R. Swann, III

*Attorney, Agent, or Firm*—Donnelly, Maky, Renner & Otto

[57] ABSTRACT

A thermal timer produces a timed duration output in response to a thermal input to a thermal storage device and a thermal energy leakage parameter from that storage device. The storage device preferably is a metal slug positioned in a silica aerogel insulative powder environment, and the thermal input is supplied by an electrically energized PTC heater. A thermostat output device monitors the temperature of the heater and the storage device to effect a distinguishable output, for example, by completing or opening an electrical circuit, in response to the temperature thereof. The thermal timer may be utilized in a range appliance or the like to effect a warning indication during cool down of that appliance.

23 Claims, 4 Drawing Figures

CIRCUIT ENERGIZATION INDICATOR WITH THERMAL TIMING MEANS TO MAINTAIN THE INDICATION FOR A PREDETERMINED TIME AFTER DE-ENERGIZATION

BACKGROUND OF THE INVENTION

The present invention is directed to a thermal timer and, more particularly, to a timer device that produces a distinguishable output at a time determined by a thermal dissipation or thermal leakage parameter.

Moreover, the present invention is directed to a thermal timer device for effecting a warning signal function on a range appliance or the like during operation and subsequent cool down to a temperature that is relatively safe to the touch of at least a portion of such a range or the like. It will be appreciated, however, that the thermal timer of the invention may be otherwise used to effect a distinguishable output for a period of time, for example, during and/or after the thermal energy supply thereto has been terminated.

A signal pilot light has been used to indicate to an operator of a range that has a smooth or imperforate top, which shields the electric or gas heating element or elements, that a heating element beneath the top is energized. The heat energy transferred through the top then may be used for the usual purpose of cooking food in a utensil placed on the top, and in the course of such operation the top becomes hot to the point of being unsafe to the operator's touch. While the heating element is energized, the usually also energized signal pilot light provides a suitable signal thereof. However, after the heating element which may be, for example, an electric resistance-type, a gas burner-type, or other suitable type that ultimately may be employed to effect heating of food, a cooking utensil or the like placed on the cook top, has been de-energized, for example, by turning off the electric energy or gas supply thereto, the previously heated area of the cook top will remain relatively hot for a period of time, although the signal pilot light will have been extinguished upon such de-energization of the heating element. The time required for the hot area of the cook top to cool down to near ambient temperature varies with cook top-ambient temperature differential, the material of the cook top and its thermal capacity, and it has been found that many conventional solid cook tops will cool down to near ambient temperature after having been heated to maximum normal operating temperature in approximately 30 to 40 minutes after the heating element has been de-energized.

Accordingly, there is a need to give a warning signal to the range operator or other person that an area of the cook top is hot and unsafe to touch while that area cools down after the heating element therebeneath has been de-energized. Since conventional thermostats do not have an operational temperature range, say, for example, between a safe near ambient temperature of 140° F. and approximately 1,500° F., the temperature often reached by the heating element of a range, it is not possible to use a warning light operated by a simple thermostat positioned in proximity to a heating element to monitor the cook top temperature. Therefore, it has been proposed to use a timer device triggered to operate a warning light for a period of time when the heating element has been de-energized. While conventional electrical timer devices may be used to operate such a warning light, these timer devices may be relatively expensive and/or unable to withstand the normal temperatures and other environmental conditions present in a range, etc., and for these and other reasons are undesirable.

SUMMARY OF THE INVENTION

The thermal timer of the present invention is energized to receive an energy input when a heating element of such a smooth top range, for example, is energized. The energy input is in the form of thermal energy or is in another energy form that is converted to thermal energy, and the input thermal energy is stored in the timer device. Upon de-energization of such heating element, the energy input to the thermal timer is terminated, whereupon thermal energy stored in the thermal timer is dissipated or leaked at a known rate as the temperature of the thermal timer equilibrates with respect to ambient temperature. During at least part of that thermal energy dissipation or leakage period the thermal timer will effect a distinguishable output, for example, by closing thermostatic contacts that complete a warning light energization circuit to signify that the range top has a hot area. Then, after a predetermined quantity of heat has been dissipated and the thermal timer has achieved a temperature nearer to ambient, the mentioned warning light will be de-energized, for example by opening of the thermostatic contacts.

In one embodiment of the invention the thermal timer includes a thermal storage device located in a relatively thermally insulative environment, a means for supplying thermal enegy to the storage device, and a temperature responsive output device which provides an output indicative of the temperature of the storage device. The storage device in its environment has a thermal leakage parameter with respect to time, and the output device will be operated to produce its distinguishable output usually shortly after the storage device has begun to receive a thermal energy input and will continue to be so operated for a predetermined duration after the thermal energy supply is terminated, determined by such thermal leakage parameter.

In a preferred form of the invention the storage device is a steel or iron slug and the thermal energy input is supplied in the form of heat by an electrically energized positive temperature coefficient of resistance material (referred to hereinbelow as PTC heater). The output device may be a thermostat type device positioned in relative proximity to the storage device and/or the PTC heater so that electrical contacts associated with the thermostat may be opened and closed in response to the temperature of the storage device and/or the PTC heater.

It will be appreciated that although the invention will be described in detail hereinafter with regard to a thermal energy input in the form of heat that tends to raise the temperature of the storage device with respect to ambient, the invention also comprehends the use of a cold energy input that tends to lower the storage device temperature with respect to ambient. The output device may be other than thermostat contacts and the heat may be supplied by heaters other than a PTC heater to a storage device other than a steel slug. The important function realized in the invention is that sometime after commencing a thermal energy input to the thermal timer and/or for a duration during the equilibration period back to ambient temperature after that energy input has been terminated, a distinguishable output is produced by the thermal timer.

In using the thermal timer of the invention to warn of a hot cook top, the PTC heater may be coupled to receive an electrical input whenever one or more of the range heating elements is energized, and the thermostatically controlled contacts of the output device may be coupled to energize a warning light in its circuit commencing shortly, for example, from about 2 to 30 seconds, after the PTC heater has been energized. Since the PTC heater has a fixed curie temperature above which its temperature normally will not rise very much, the temperature of the steel slug storage device will not exceed that maximum temperature. When the range heating element and the thermal timer PTC heater are de-energized, heat leaks or is dissipated from the steel slug, which may be located in a surrounding thermally insulative environment, for example, of silica aerogel, and after the steel slug is cooled sufficiently, the output contacts will open de-energizing the warning light.

With the foregoing in mind, a primary object of the invention is to provide a measurement of a timed interval in response to a thermal leakage parameter of a thermal storage device.

Another object of the invention is to provide a distinguishable output for a timed duration in response to a thermal input.

An additional object of the invention is to provide a distinguishable output commencing shortly after initiation of a thermal input and continuing for a timed duration after termination of such thermal input.

A further object of the invention is to provide a warning indication that an area of a range cook top is hot even after the range heating element has been de-energized.

These and other objects and advantages of the present invention will become more apparent as the following description proceeds.

To the accomplishment of the foregoing and relatedends the invention, then, comprises the features hereinafter fully described and particularly pointed out in the claims, the following description and the annexed drawing setting forth in detail a certain illustrative embodiment of the invention, this being indicative, however, of but one of the various ways in which the principles of the invention may be employed.

DESCRIPTION OF THE PREFERRED EMBODIMENT

Figure 1:
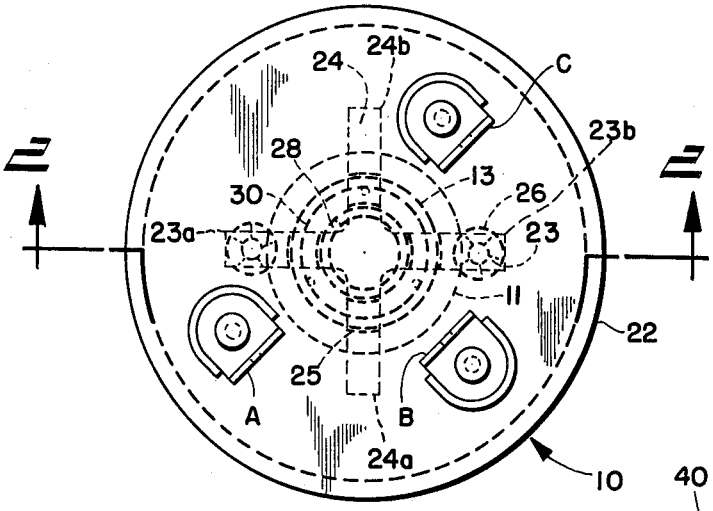
FIG. 1 is a top view of the thermal timer of the invention.
Figure 2:
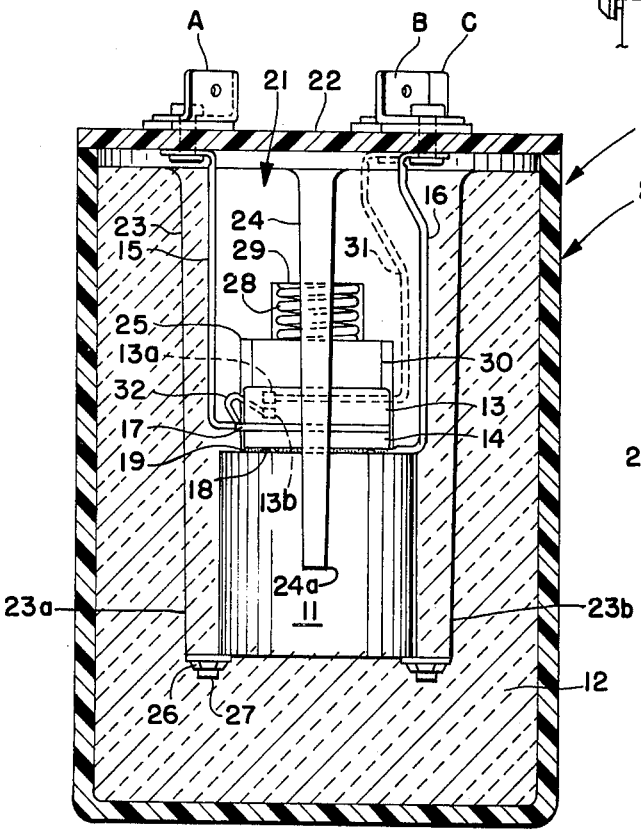
FIG. 2 is a section view looking in the direction of the arrows 2—2 of FIG. 1 illustrating generally in sectional elevation the components of the terminal timer.

Referring now to the drawing, wherein like reference numerals designate like parts in the several figures, and initially to FIGS. 1 and 2, the thermal timer is generally indicated at 10. The thermal timer 10 includes an iron or low carbon steel slug thermal storage device 11 positioned in a thermally insulative environment 12 and a thermostat output device 13 positioned in relative heat sensing proximity to the storage device 11 for sensing the temperature thereof to produce a distinguishable output in the form of movable opened or closed contacts 13*a,* 13*b* in response thereto.

Positioned in heat transfer relation with both the storage device 11 and the output device 13 is a PTC heater 14 that generates heat as the thermal input to the timer device 10 in response to an electrical input received at the input terminals A, B. The electrical input to the terminals A, B may be 120 to 140 volts, 50 or 60 Hz AC power from the utility company, and electrical leads 15, 16 provide that input power from the terminals A, Bto the opposite sides or surfaces of the PTC heater 14. Preferably one surface of the PTC heater 14 is is abutment with an electrically conductive sheet metal structure 17 that serves as an attachment point for the lead 15 to both the PTC heater and the thermostat 13 and that provides both electrical continuity and heat transfer between components. The other surface of the PTC heater 14 is supported on three upstanding lands or bumps 18 formed in the confronting surface of the steel slug 11. The bumps 18 assure effective electrical contact with the steel slug 11 to which the lead 16 may be attached, and preferably the height of the bumps 18 is only about 0.001 to 0.002 inch above the slug surface so that there is still efficient heat transfer between the PTC heater and the steel slug. Moreover, if desired, a quantity of Wakefield thermal grease 19 may be used between the steel slug storage device 11 and the PTC heater 14 to supplement heat transfer therebetween. Alternatively the PTC heater 14 and the storage device may be adhesively bonded by an electrically conductive and thermally conductive epoxy, thus assuring good electrical and thermal transfer therebetween.

The storage device 11, output devices 13 and PTC heater 14 are suspended in a hollow cylindrical container 20 by a molded phenolic support 21 which extends into the hollow of the container from the container top 22. The support 21 preferably compriss a pair of perpendicular planar walls 21, 24, the former being longer than the latter, and each wall has a portion cut away to form respective pairs of legs 23*a,* 23*b* and 24*a,* 24*b* located on diametrically opposite sides of a steped hollow space or recess configuration generally bounded by the walls 23, 24 and the legs thereof as indicated at 25 to receive and to retain the storage device 11, output device 13, and PTC heater 14 in suspended relation within the container 20. A pair of friction retaining clips 26 secured to stubs 27 of the loner legs 23*a,* 23*b* hold the elements 11, 13 and 14 in the stepped recess 25, and a spring 28 in compression between the top wall 29 of the recess 25 and a spacer block 20 in abutment with the output device 13 urges the elements 11, 13, 14, 17 and 18 to good abutting relationship in order to ensure effective and efficient thermal and electrical coupling therebetween. The spring force of the spring 28 may be on the order of, for example, 4 pounds to provide the suitable contact pressures among the elements without causing a failure in the retaining clips 26, and the spacer 30 may be designed to allow freedom of movement of the output device contacts 13*a,* 13*b.*

The thermally insulative environment 12 preferably is a silica aerogel thermal insulation powder that preferably completely fills the remainder of the container 20, although in FIG. 2 part of the shading lines indicative of the insulating powder is not shown only for clarity. The container 20 may be of electrically conductive or nonconductive material, such as plastic-like material or metal material, and the principal function of the container 20 is to contain the insulative powder and to retain the storage device 11, output device 13 and PTC heater 14 supported in immersion therein in the insulative environment. The use of a plastic-like container, however, has two distinct advantages over a metal container, including, first, a generally reduced heat conductivity adding to the thermal insulation about the storage device 11 and, second, an electrical insulation property that facilitates feed through connections in the container top 22 between the input power terminals A, B and the output circuit terminals A, again, and C to the internal electrical leads 15, 16, 31.

Figure 4:
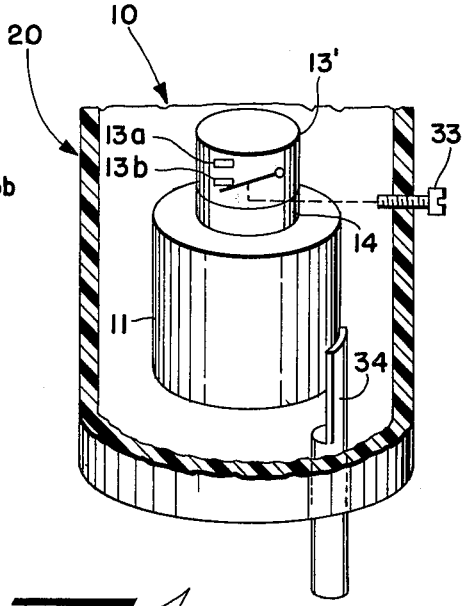
FIG. 4 is a schematic view of a part of the thermal timer adjustment means therefor.

The thermostat output device 13 may be a conventional snap disc thermostat, which includes a pair of normally open contacts, shown at 13*a*, 13*b*. When the temperature of the thermostat output device 13 exceeds, for example, 135° F., the contacts 13*a*, 13*b* will be closed by a responsive action of the snap disc to complete an electrical circuit between the lead 31 and the lead 15 via a jumper connection 32. If desired, an adjustable thermostat output device 13', as shown in FIG. 4, may be used to effect adjustment of the timed duration offered by the thermal timer device 10. By adjusting the screw 33 a bias on the contacts 13*a*, 13*b* may be varied, thus changing the temperature at which they will switch.

In operation of the thermal timer 10, initially the contacts 13*a*, 13*b* are open, although in some instances it may be desired to have those be normally closed contacts, and electric power is applied to the input terminals A, B to initiate heating in the PTC heater 14. The PTC heater is formed of barium titanate or like material that heats upon application of an electrical input, and the resistance of the PTC heater increases as its temperature increases. Therefore, the PTC heater has a Curie temperature, in a preferred embodiment of approximately 320° F., and the usual self-limited maximum operating temperature of the PTC heater having such a Curie temperature will be on the order of approximately 350° F.

Upon receiving an electrical input a PTC heater normally will first heat to its maximum temperature at its mid-plane. However, because the lower side, as shown in FIG. 2, of the PTC heater wafer 14 is heat sinked to the steel slug storage device 11, there is a shift in the maximum heating plane of the PTC heater wafer 14, whereby maximum heating will occur more proximate the non-heat sinked surface, i.e. the upper surface as shown in FIG. 2. Therefore, shortly after the electrical input is supplied the PTC heater 14, its upper surface will heat sufficiently to effect closure of the contacts 13*a*, 13*b* in the thermostat output device 13 completing a circuit between the terminals A, C.

In the preferred embodiment of the invention, wherein ambient temperatures are on the order of 80° F., a PTC heater on the order of 22 millimeters diameter and 1.5 millimeters thickness will heat sufficiently within from 1 to 15 seconds to effect snap closure of the contacts 13*a*, 13*b* in the snap disc thermostat output device 13 in which contact closure occurs when the snap disc achieves a temperature of approximately 135° F. As the PTC heater 14 continues to heat, it will supply thermal energy to the steel slug storage device 11, and at the same time a certain amount of the heat stored in the steel slug storage device as well as heat generated by the PTC heater will be leaked or dissipated through the thermally insulative environment 12 to the lower temperature ambient environment.

Upon termination of the electrical input to the PTC heater 14, heat stored in the steel slug storage device 11 will continue tot leak through the thermally insulated environment 12 to the ambient environment tending to equilibrate the temperature of the storage device and the ambient environment. HOwever, the contacts 13*a*, 13*b* in the output device 13 will remain closed until the temperature of the storage device 11 and that of the thermostat output device 13 drops below the action point of the snap disc, say 135° F. in the preferred embodiment, whereupon the contacts 13*a*, 13*b* will open the circuit between the terminals A and C.

The timed duration required for the contacts 13*a*, 13*b* to open after the electrical input to the PTC heater 14 is terminated will depend on the terminal leakage or dissipation rate or parameter from the storage device 11 to the ambient environment. Accordingly, the duration for which the contacts remain closed after interruption of electrical input to the PTC heater is variable with respect to the thermal storage capacity of the storage device 11, the thermally insulative value of the thermally insulative environment 12, the size of the various elements in the thermal timer device 10 including, particularly, the size of the container 20, and so on. Actually, for a given size thermal storage devices 11, output device 13, and PTC heater 14, an optimum size for the container 20 and the silica aerogel insulation 12 therein may be determined to obtain a maximum duration of contact closure after the electrical input is removed from the terminals A, B; this maximum size can be determined experimentally or mathematically in accordance with an understanding that a point of optimum insulation thickness is reached when less insulation will permit too great a heat leakage rate and a greater thickness will increase the surface area of the container 20 and tus the heat leakage rate therefrom.

It should be understood that although the thermal timer device 10 is illustrated and described in uncomplicated form, whereby a single pair of contacts 13*a*, 13*b* are closed shortly after an electrical input is supplied to the input terminals A, B and those contacts remain closed for a timed duration after removal of that electrical input, by modification of the number of contacts in the output device 13, the temperatures at which one or more sets of those contacts will switch from open or closed condition to the opposite condition, etc. more complex, but nevertheless similar, thermal timers may be constructed within the spirit and scope of the present invention. It also will be appreciated that by selecting a thermostat output device 13 which will switch at a temperature, say 135° F., reasonably above normal ambient temperatures the switching point of the output device 13 and, therefore, the timed duration of the thermal timer will be made relatively insensitive to the ambient temperatures. As mentioned above with reference to FIG. 4, the timed duration of the thermal timer may be varied by providing for adjustability of the output device 13', and such variation also may be obtained by using an adjustable thermal shunt, such as a thermally conductive rod 34 movable to and away from the storage device 11 through a tight opening in the container to vary thermal loss therefrom. Adjustment of the timed duration also may be effected by varying the mass of the thermal storage device 11.

A thermal timer, including a cylindrical plastic container 2.2 inches in diameter and 3 inches long, a cylindrical steel slug storage device having a 0.875 inch diameter and longitudinal length, a PTC heater wafer having 0.875 inch diameter and 1.5 millimeter thickness, a snap disc operated thermostat output device with contacts that switch at 135° F., and silica aerogel insulation, was tested under ambient temperature conditions at approximately 80° F. The PTC heater was energized in separate tests, respectively, for 2, 3 4, 10 and 15 minutes with 120 volt AC power. In each test the output contacts closed within between 1 and 15 seconds after the PTC heater had been energized, and the turn off times at which the contacts opened after the electrical input to the PTC heater had been terminated, i.e. the timed duration, were, respectively, 32, 38, 43, 46 and 46 minutes. Therefore, it can be seen that maximum turn off time will be on the order of 46 minutes, whereas the shortest turn off time will be on the order of 30 to 32 minutes. Moreover, it has been found that the timed duration of turn off time at which the contacts open will increase by approximately only 1 minute for each increase in ambient temperature of approximately 4° F., and a similar reduction in the turn off time will be realized for corresponding reductions in the ambient temperature.

Figure 3:
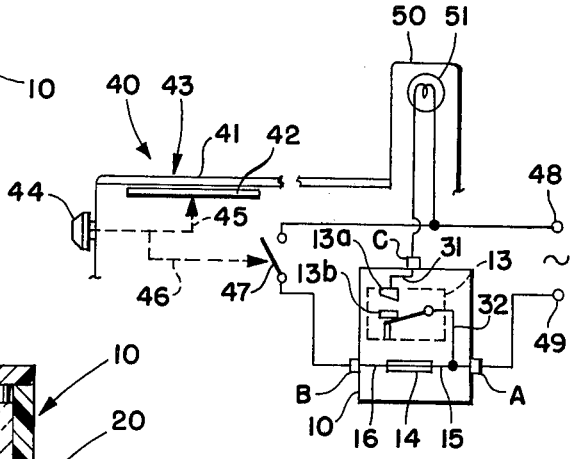
FIG. 3 is a schematic illustration of the thermal timer of the invention used in circuit in a smooth top range appliance to operate a warning lamp.

Turning now more particularly to FIG. 3, the thermal timer device 10 is located in a conventional smooth top range appliance 40. The range 40 has a relatively solid imperforate cook top 41 beneath which the schematically shown heating element 42 of the electrical or gas type is located to heat the area 43 immediately thereabove. Although the range 40 is shown with only a single heating element 42, it may include a plurality of such heating elements to heat other specified areas of the cook top 41. A control knob 44 on the front of the range 40 may be manually adjusted to control the electric or gas supply, not shown, to the heating element 42 and thus the desired energy output therefrom, as is schematically shown by the connection 45. Moreover, further connection between the control knob 44 is shown at 46 to effect closure of a switch 47 to supply AC power from the power supply terminals 48, 49, which may be a conventional electric plug, to the input terminals A, B of the terminal timer 10. At the back of the range 40 is a usual splash guard 50 within which a warning light 51 is located. It is this warning light 51 that will be energized by the thermal timer 10 to indicate that an area of the cook top 41 is hot.

Preferably only a single thermal timer device 10 is used for a range that may have one or more heating elements, most present day ranges employing four heating elements, and the switch 47 will be closed to supply input electric power to the thermal timer 10 when any one or more of the range control knobs has been adjusted to an on position. Accordingly, a single warning light 51 may be used to indicate that at least one of the several cook top areas is hot. However, if desired, a respective thermal timer device 10 and warning light 51 may be used for each of the heating elements of the range 40 so as to identify which specific area of the cook top is currently hot. The warning light 51 will normally be separate from the conventional signal pilot lights used to indicate which of the heating elements of the smooth top range is energized, although both the warning light and the appropriate signal pilot light or lights may be concurrently energized.

Using the thermal timer device 10 in the range 40 of FIG. 3, upon energization of the heating element 42 by appropriate adjustment of the control knob 44, the switch 47 will be closed to supply electrical input power to the PTC heater 14. Approximately several seconds after application of that power, the contacts 13*a*, 13*b* will close to effect energization of the warning light 51 indicating that an area of the cook top 41 is hot and unsafe to touch. When the control knob 44 is turned off, and assuming that all of the other control knobs and heating elements of the range 40 are off, the switch 47 will be opened, but the contacts 13*a*, 13*b* will remain closed to maintain a distinguishable output by completing a power circuit to energize the warning light 51. Then, at the expiration of the timed duration of the thermal timer 10, i.e. when a certain quantity of heat has leaked or been dissipated from the storage device 11 and its temperature and that of the output device 13 has dropped to below 135° F., for example, the contacts 13*a*, 13*b* will open effecting de-energization of the warning light 51. The mentioned duration, of course, will be selected, the various parameters of the timer device 10 being chosen accordingly, to ensure that the warning light 51 will remain energized until the temperature of the cook top 41, even when heated to a maximum temperature, will have cooled downed to a safe temperature.

As has been mentioned above, it will be appreciated that the thermal timer of the invention may be used to effect more complex switching functions, as the PTC heater and the thermal storage device vary in temperature, than the singular warning light control operation. Also, the thermal timer device may be used in other applications wherein a switching function or other distinguishable output is required with respect to a function of time.

The embodiments of the invention in which an exclusive property or privilege is claimed are defined as follows:

1. A thermal timer, comprising storage means for storing thermal energy in a thermally insulative environment having a predetermined thermal energy leakage rate, supply means for supplying thermal energy to said storage means to change the temperature of the latter from one to another temperature, and thermally responsive output means for producing a distinguishable output in response to the temperature thereof, said output means being positioned relative to said supply means to produce such distinguishable output promptly upon the initiation of the latter to supply such thermal energy, and said output means also being positioned relative to said storage means to produce such distinguishable output in response to and generally indicative of the temperature of said storage means after said supply means ceases to supply such thermal energy, the duration of continued production of such distinguishable output after termination of a supply of thermal energy by said supply means to said storage means being proportional to such thermal leakage rate.

2. A thermal timer as set forth in claim 1, said storage means comprising a metal mass.

3. A thermal timer as set forth in claim 2, said metal mass comprising a steel slug.

4. A thermal timer as set forth in claim 1, said output means comprising temperature responsive contacts.

5. A thermal timer as set forth in claim 1, said supply means comprising an electric heater and means for coupling said heater means to an electrical input.

6. A thermal timer as set forth in claim 5, said heater comprising a PTC heater.

7. A thermal timer as set forth in claim 1, said thermally insulative environment comprising silica aerogel.

8. A thermal timer as set forth in claim 1, further comprising means for adjusting said timer device to vary the time at which said distinguishable output is produced.

9. A thermal timer as set forth in claim 1, said thermally responsive output means having plural output conditions and comprising means responsive to the temperature of said supply means and said storage means for automatically producing one output condition when the temperature of both of said supply means and said storage means is below a predetermined temperature and another output condition when the temperature of at least one of said supply means and said storage means is above such predetermined temperature.

10. A thermal timer as set forth in claim 9 further comprising means for adjusting the predetermined temperature to which said output means responds to produce a different output condition.

11. A thermal timer as set forth in claim 9, further comprising means for adjusting said thermal leakage rate.

12. A thermal timer as set forth in claim 1, wherein said supply means is coupled in an appliance to supply thermal energy to said storage means upon energization of said appliance.

13. A thermal timer as set forth in claim 12, said output means comprising a thermostat responsive to the temperature of said storage means and a warning indicator energized by said thermostat to effect a discernible output at least shortly after energization of said appliance and for a duration after de-energization of said appliance depending on the temperature of said storage means and the thermal leakage rate of said thermally insulative environment.

14. A thermal timer as set forth in claim 13, wherein said appliance comprises a smooth top range and such duration substantially equals the time for a hot area of the appliance top to cool to a safe temperature.

15. A thermal timer as set forth in claim 1, said thermally insulative environment comprising thermal insulation, and further comprising container means for containment of said thermal insulation and for supporting said storage means and said output means therein.

16. A thermal timer as set forth in claim 15, said supply means comprising heater means for heating said storage means and said output means in response to an electrical input.

17. A thermal timer as set forth in claim 16, further comprising means for urging said storage means, said supply means and said output means toward abutment in sandwiched-like manner to enhance the thermal transfer therebetween.

18. A thermal timer as set forth in claim 15, said container means comprising a cylindrical container and said storage means comprising a cylindrical metal mass.

19. A thermal timer as set forth in claim 18, said supply means comprising an electric heater, said output means comprising temperature responsive contacts, and further comprising electrical means for connecting said heater to an external power supply and for connecting said temperature responsive contacts to an external electric circuit for controlling such circuit.

20. A thermal timer as set forth in claim 19, said heater comprising a PTC heater.

21. A thermal timer as set forth in claim 10, said PTC heater having opposed surfaces, one being coupled in heat transfer relation to said metal mass and the other being coupled in heat transfer relation to said output means.

22. A thermal timer as set forth in claim 21, further comprising means for enhancing the thermal coupling among said PTC heater, said metal mass and said output means, said means for enhancing comprising a respective metal thermally conductive structure and thermally conductive grease between said output means and said PTC heater and between said PTC heater and said metal mass.

23. A thermal timer set forth in claim 15, said thermal insulation comprising thermally insulative powder.

* * * * *